US007909429B2

(12) United States Patent
Morikoshi

(10) Patent No.: US 7,909,429 B2
(45) **Date of Patent: *Mar. 22, 2011**

(54) LIQUID EJECTION APPARATUS

(75) Inventor: Koji Morikoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 931 days.

This patent is subject to a terminal disclaimer.

(21) Appl. No.: 11/707,119

(22) Filed: Feb. 16, 2007

(65) Prior Publication Data

US 2007/0188544 A1 Aug. 16, 2007

(30) Foreign Application Priority Data

Feb. 16, 2006 (JP) ..... 2006-039308
Feb. 16, 2006 (JP) ..... 2006-039309

(51) Int. Cl.
*B41J 2/165* (2006.01)

(52) U.S. Cl. ..... 347/29

(58) Field of Classification Search ..... 347/22, 347/29, 31

See application file for complete search history.

(56) References Cited

U.S. PATENT DOCUMENTS

| | | | | |
|---|---|---|---|---|
| 6,672,704 | B2 * | 1/2004 | Katakura et al. | 347/23 |
| 6,746,096 | B2 | 6/2004 | Sakamoto et al. | |
| 6,796,633 | B1 | 9/2004 | Kawamata et al. | |

FOREIGN PATENT DOCUMENTS

| | | | |
|---|---|---|---|
| JP | 2002052740 | A | 2/2002 |
| JP | 2002052744 | A | 2/2002 |
| JP | 2002361889 | A | 12/2002 |
| JP | 2006224420 | A | 8/2006 |
| JP | 2003-251828 | A | 9/2006 |

* cited by examiner

*Primary Examiner* — An H Do
(74) *Attorney, Agent, or Firm* — Sughrue Mion, PLLC

(57) ABSTRACT

A liquid ejection apparatus includes: an ejection head that ejects a liquid from a nozzle; a cap that can seal an opening of the nozzle; an absorber that is disposed in the inside of the cap; a first ejection unit that allows to perform a first ejection toward the cap for maintenance of the nozzle; a suction unit that sucks the liquid from the cap; a second ejection unit that allows to perform a second ejection toward the cap for supplementing the liquid to the inside of the cap, before the suction; and a history managing unit that manages information on an accumulated ejection amount of a moisturizing component of the first ejection, wherein the second ejection unit allows to perform the second ejection on a condition based on the information.

6 Claims, 6 Drawing Sheets

LIQUID EJECTION APPARATUS

BACKGROUND

1. Technical Field

The present invention relates to liquid ejection apparatuses such as an ink jet record apparatus, a display manufacturing apparatus, an electrode forming apparatus, and a biochip manufacturing apparatus which perform a drawing operation or the like by ejecting liquid from a nozzle.

2. Related Art

In related art, as a liquid ejection apparatus, an ink jet printer (hereinafter, referred to as a printer) which is appropriate for printing on a paper is known. Generally, the printer has a configuration in which a head including a fine nozzle for ejecting liquid (ink) is disposed to be movable in a status the head faces paper.

When the ink within the nozzle is dried, the printer cannot perform normal ejection, and accordingly, the technology for preventing the dryness or restoring moisture from the dry status is very important. Generally, a cap which is used for sealing (capping) an opening of the nozzle is prepared in the printer, and by capping the opening of the nozzle in a standby mode of the printer, the dryness of the ink within the nozzle can be prevented.

In addition, a printer that restores and maintains the performance of ejection by ejecting ink onto something other than a paper face before/after a drawing operation or in the middle of the drawing operation to replace old ink for which a drying process has been progressed in the nozzle with new ink is widely known. The above-described ejection for nozzle maintenance is called preliminary ejection, and in many cases, the preliminary ejection is performed onto a cap.

In related art, an absorber for retaining ink is prepared in a cap, and the sealed internal space by capping is configured to maintain high humidity by the moisture of the ink retained in the absorber. In a printer including a function of the above-described preliminary ejection, there is a case where the ink ejected in the preliminary ejection accelerates the drying process in the capped status on the contrary. This happens since a moisturizing component (glycerin or the like) in a status that contained moisture has been lost is accumulated in the absorber as time passes after the preliminary ejection, and accordingly, the moisturizing component acts for aggressively taking moisture from the ink in the nozzle when the nozzle is capped.

Considering this case, the applicant of the present invention has filed an application for an invention related to a structure of a cap for preventing ink from being remained inside (see Patent Document 1).

Patent Document 1: JP-A-2003-251828

However, although a cap related to the Patent Document 1 can prevent an adverse effect due to a moisturizing component included in ink, a function of maintaining moisture is lost when the cap is used, and a drying process in the nozzle cannot be sufficiently suppressed after being left for a long time.

In addition, when forced discharge of the ink ejected from the preliminary ejection is tried using a suction unit which communicates with the cap in the structure of the cap including an absorber, the ink already has lost much of the moisture to be in a high viscosity status, and accordingly the ink can rarely be discharged.

SUMMARY

An advantage of some aspects of the invention is to provide a liquid ejection apparatus capable of appropriately suppressing the drying process of liquid in a nozzle in a capped status. The advantage can be attained by at least one of the following aspects:

A first aspect of the invention provides a liquid ejection apparatus comprising: an ejection head that ejects a liquid from a nozzle; a cap that can seal an opening of the nozzle; an absorber that is disposed in the inside of the cap; a preliminary ejection unit (first ejection unit) that allows to perform a preliminary ejection (first ejection) toward the cap for maintenance of the nozzle; a suction unit that sucks the liquid from the cap; a replenishing ejection unit (second ejection unit) that allows to perform a replenishing ejection (second ejection) toward the cap for supplementing the liquid to the inside of the cap, before the suction; and a history managing unit that manages information on an accumulated ejection amount of a moisturizing component of the preliminary ejection, wherein the replenishing ejection unit allows to perform the replenishing ejection on a condition based on the information.

A second aspect of the invention provides a liquid ejection apparatus comprising: an ejection head that ejects a liquid from a nozzle; a cap that can seal an opening of the nozzle; an absorber that is disposed in the inside of the cap; a preliminary ejection unit (first ejection unit) that allows to perform a preliminary ejection (first ejection) toward the cap for maintenance of the nozzle; a suction unit that sucks the liquid from the cap; a replenishing ejection unit (second ejection unit) that allows to perform a replenishing ejection (second ejection) toward the cap for supplementing the liquid to the inside of the cap, before the suction; and a history managing unit that manages an accumulated time of drawing operations, wherein the replenishing ejection unit allows to perform the replenishing ejection on a condition based on the accumulated time.

In the liquid ejection apparatus according to these aspects of the invention, since suction is performed after new liquid is supplemented (supplemental ejection) to an absorber, it is possible to wash old (having no moisture) liquid accumulated in the absorber by preliminary ejection to be flown out with new liquid for proper discharge. In the absorber, a part of the supplemented liquid is maintained. Accordingly, old liquid ejected by the preliminary ejection does not precipitate a drying process inside the nozzle in a capped status of an opening of the nozzle, and the drying process of the inside of the nozzle can be prevented by a moisture component of the liquid maintained in the absorber.

Generally, as time elapses after the preliminary ejection, the absorber contains many old moisturizing components to precipitate a drying process inside the nozzle in a capped status or to make it difficult to wash the moisturizing components to be flown out. However, in the liquid ejection apparatus according to these aspects of the invention, information on the accumulated amount of ejection of a moisturizing component during the preliminary ejection or the history time of a drawing operation is managed, and accordingly it becomes possible to discharge the moisturizing components on a proper condition based on the information or the history time.

The moisture of the liquid represents a main solvent component, and the moisturizing component of the liquid represents an additive having a property of maintaining the moisture.

In the liquid ejection apparatus according to these aspects of the invention, the liquid ejection apparatus may include a plurality of the nozzles and the caps provided for each one of a plurality of liquid types, and the replenishing ejection unit may set an ejection amount of a moisturizing component of the replenishing ejection for each of the liquid types.

In addition, the replenishing ejection unit allows to perform the replenishing ejection right before a main power is turned off.

The present disclosure relates to the subject matter contained in Japanese patent application Nos. 2006-039308 filed on Feb. 16, 2006 and 2006-039309 filed on Feb. 16, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described in detail with reference to accompanying drawings.

Since the embodiments to be described below are detailed examples of preferred embodiments of the invention, although various limitations which are technically preferable are imposed, the scope of the invention is not limited thereto unless description for limiting the scope of the invention is included. For the convenience of illustration, the horizontal and vertical reduced-scales of a member or a part may be different in the accompanying drawings.

Configuration of Liquid Ejection Apparatus

At first, a configuration of a liquid ejection apparatus will be described with reference to FIGS. 1, 2, and 3.

Figure 1:
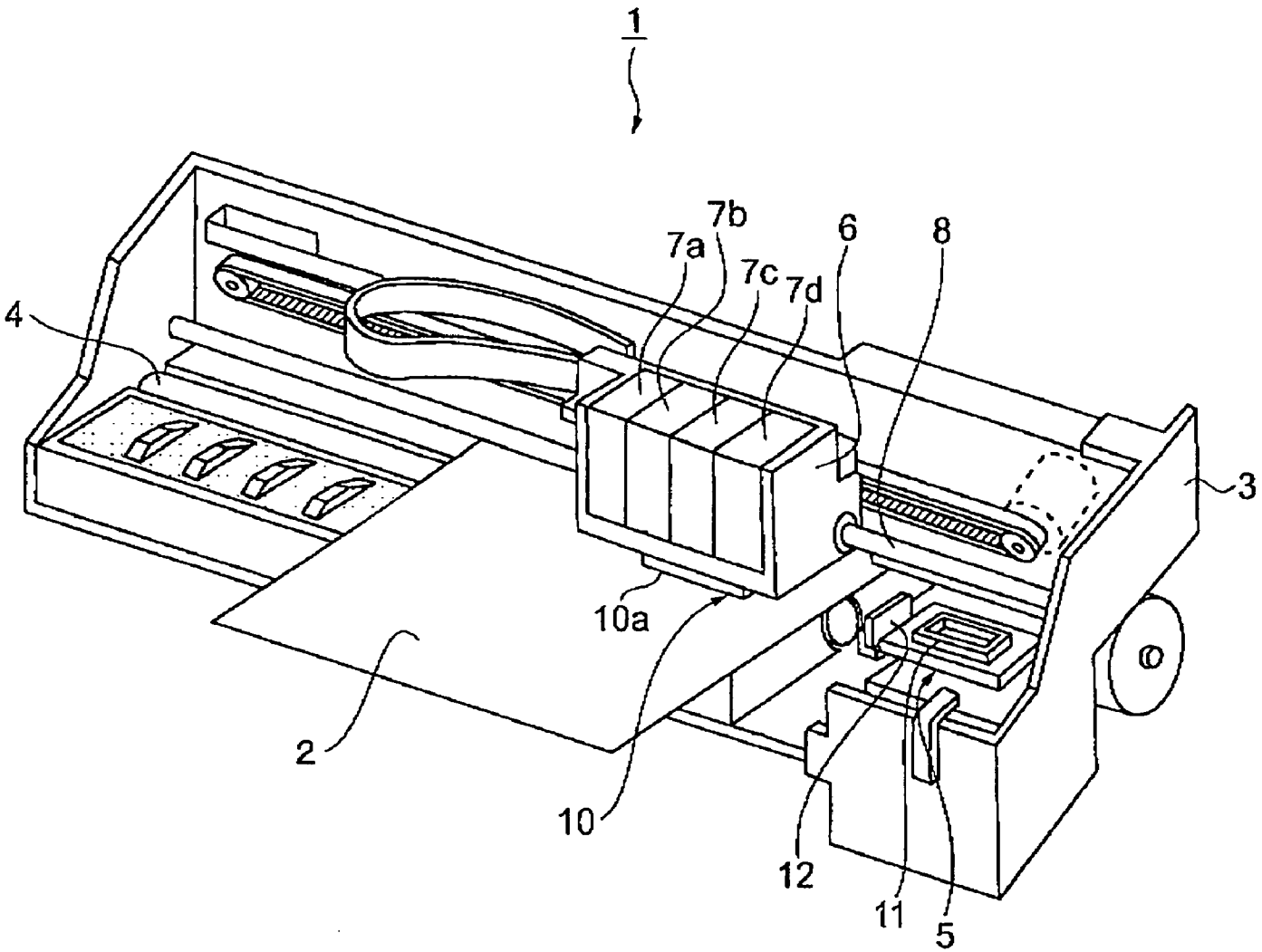
FIG. 1 is a schematic perspective view showing a whole configuration of a liquid ejection apparatus.

FIG. 1 is a schematic perspective view showing a whole configuration of a liquid ejection apparatus. FIG. 2 is a partially exploded side view showing a peripheral configuration of a cap. FIG. 3 is a block diagram showing an electrical configuration of a liquid ejection apparatus.

Referring to FIG. 1, a printer 1 as a liquid ejection apparatus includes a guide frame 3 formed of a steel plate or the like, a transport roller 4 which transports paper 2, an ejection head 10 having a nozzle face 10*a* on which a fine nozzle is installed, and a maintenance unit 5 which is used for performing nozzle maintenance of the ejection head 10. The ejection head 10 is installed in a carriage 6 to reciprocate (eject) along a guide rod 8. The guide frame 3 forms a base of the whole apparatus using its strength and weight and serves as an electrical earth.

In the carriage 6, ink cartridges 7*a* to 7*d* into which color inks (ink) of four colors in a liquid status are inserted respectively are installed, and accordingly, the color ink of each color is supplied to the ejection head 10. By controlling each nozzle of the ejection head 10 in synchronization with the scan of the carriage 6 and the transport of the paper 2, an image or the like is formed on the paper 2 with ink droplets.

The maintenance unit 5 includes a cap 11 which can seal (cap) an opening of a nozzle by closely contacting the nozzle face 10*a* of the ejection head 10 and a wiper blade 12 which is a member formed in the form of a plate with rubber or the like. The cap 11 is used for an operation of nozzle maintenance to be described later as well as is used for protecting a nozzle from a dust or being dried. The wiper blade 12 is used for removing ink attached to the nozzle face 10*a*.

Figure 2:
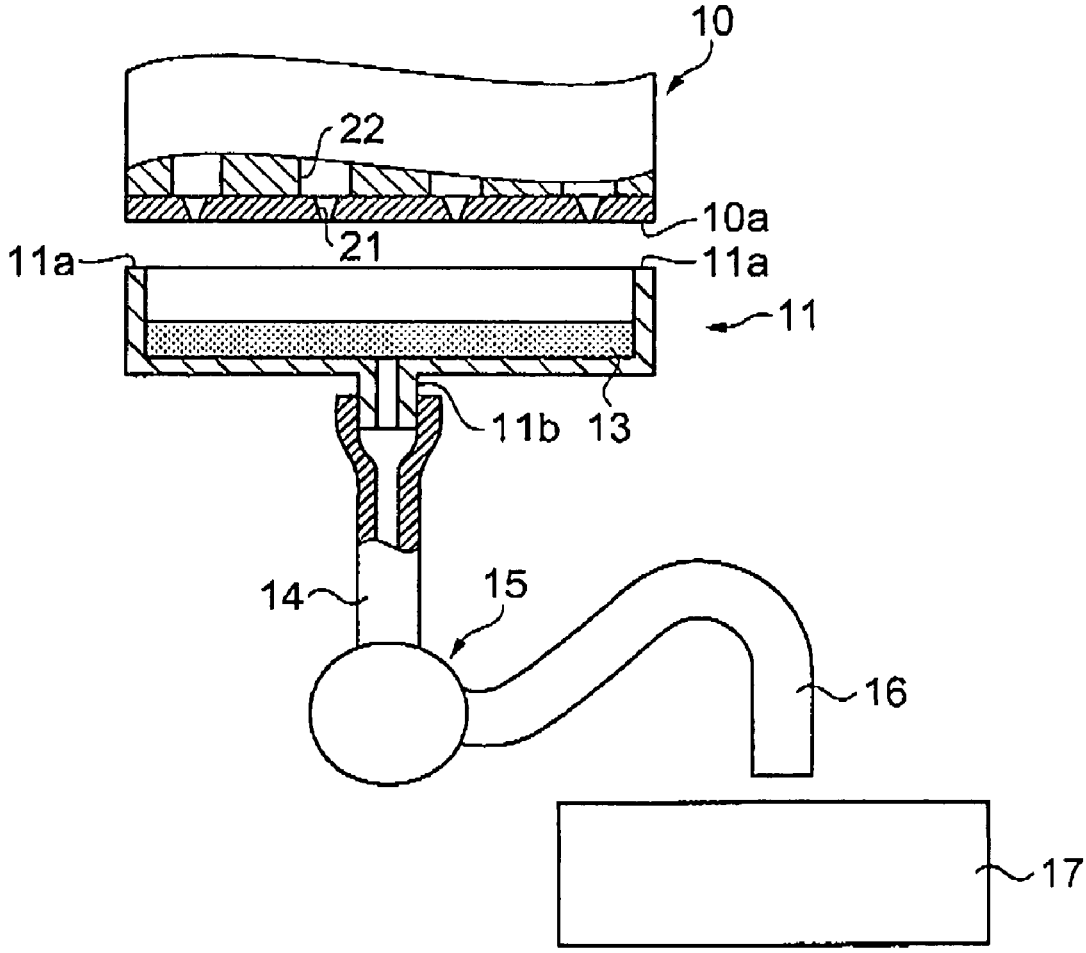
FIG. 2 is a partially exploded side view showing a peripheral configuration of a cap.

Referring to FIG. 2, the ejection head 10 includes a nozzle 21 which is installed in the form of a line to the nozzle face 10*a* for each corresponding type of ink and a pressure generating chamber 22 which communicates with each nozzle 21. A part of the pressure generating chamber 22 is designed to be transformed by a piezoelectric element, and accordingly, by driving the piezoelectric element, a pressure is generated in the pressure generating chamber 22 to perform ejection of ink.

The cap 11 is a member in the form of a box which has an opening on a side face facing the ejection head 10. The cap 11 has elasticity in an edge part 11*a* of the opening, and accordingly, by closely contacting the edge part 11*a* of the opening to the nozzle face 10*a*, the cap 11 can seal (cap) the opening of the nozzle 21. In the cap 11, an absorber 13 formed of sponge or nonwoven fabric is disposed. The disposition of the absorber 13 is for maintaining high humidity in the inside of the cap 11 in a capped status by a function of keeping ink which the absorber 13 contains.

The cap 11 is maintained by a slider mechanism (not shown) and moved in an upward/downward direction (a direction in which the nozzle face 10*a* gets closer to or father from the nozzle face 10*a* in conjunction with the movement of the ejection head 10 in the direction of scanning. Accordingly, by controlling the scan of the ejection head 10, the capping and the release of the capping can be performed as required.

In the bottom part of the cap 11, a communication nozzle 11*b* is formed, and the communication nozzle 11*b* is connected to one end of the communication tube 14. It is preferable that the communication tube 14 has appropriate flexibility, considering that the cap 11 is configured to be moved by the slider mechanism. In addition, it is preferable that the cap 11 is made of material through which vapor cannot easily penetrate from a wall in a capped status, considering that a space which communicates with a sealed space in the cap 11 is formed by the cap 11.

The other end of the communication tub 14 is connected to a suction pump 15 (schematically drawn) as a suction unit. As the suction pump 15, a tube pump or the like which is small in size and has a high efficiency is properly used. The suction pump 15 can absorb ink (inside cap suction) remaining in the inside of the cap 11 in an uncapped status as well as well as can absorb ink (inside nozzle suction) from the inside of the nozzle 21 in a capped status. The absorbed ink is placed in a waste ink tank 17 through a waste liquid tube 16 which communicates with an outlet of the suction pump 15.

The inside nozzle suction is performed for restoring the performance of ejection by forcedly discharging dried ink when the ink of the inside of the nozzle 21 is dried and comes to be fixed or have a high viscosity for which ejection can be made rarely. On the other hand, the inside cap suction is performed for collecting ink discharged in the inside of the cap 11 due to the inside nozzle suction or collecting ink discharged by the preliminary ejection (described in detail later).

Figure 3:
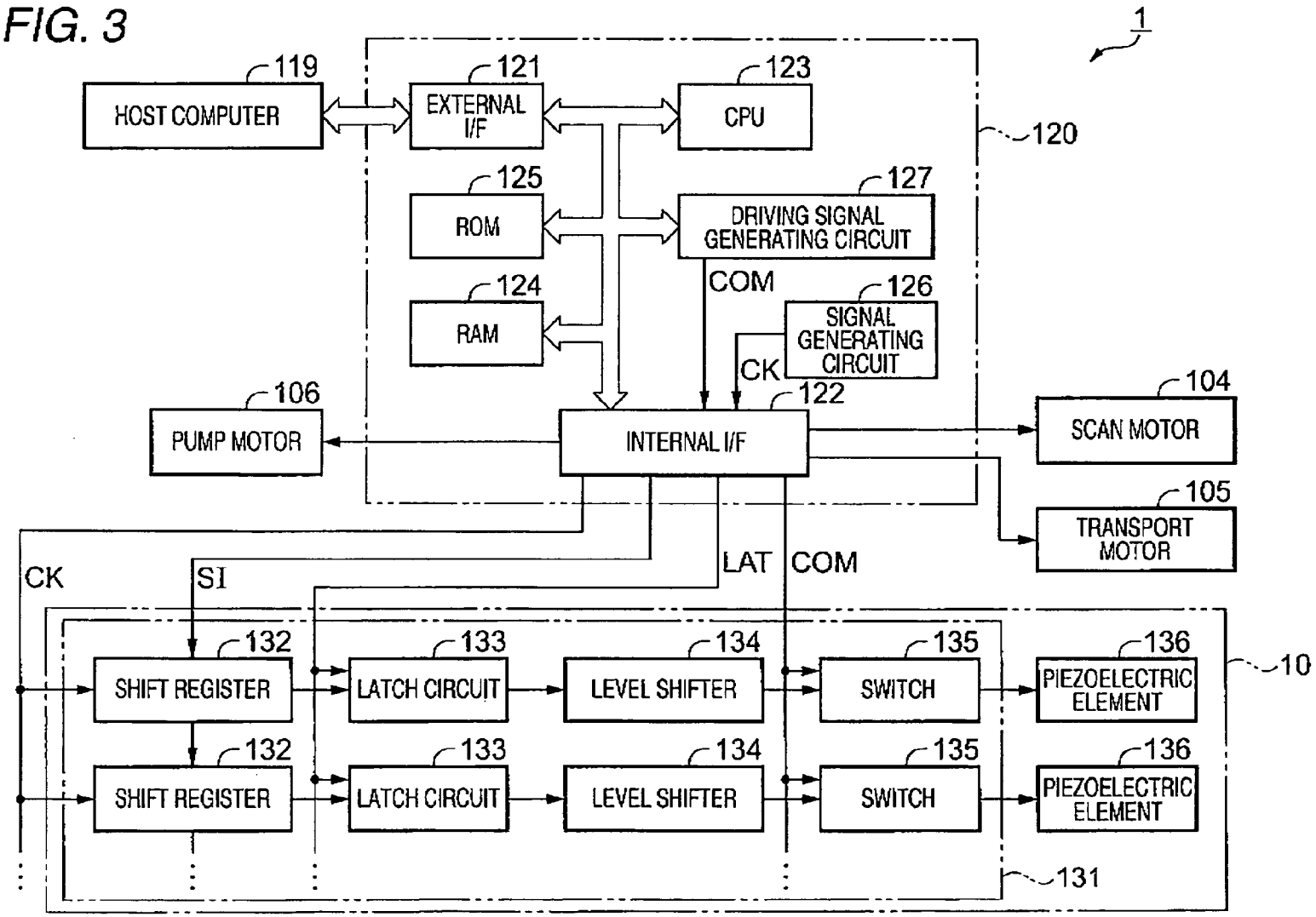
FIG. 3 is a block diagram showing an electrical configuration of a liquid ejection apparatus.

Referring to FIG. 3, the printer 1 includes a controller 120 which performs various controls related with the operation of the printer 1. A controller 120 is connected to a host computer 119 through an external interface (T/F) 121. In addition the controller 120 is connected to an ejection driving circuit 131 of the ejection head 10, a scan motor 104 for driving a scan operation of the carriage 6 (see FIG. 1), a transport motor 105 for driving a transport roller 4 (see FIG. 1), and a pump motor 106 for driving the suction pump 15 (see FIG. 2), through an internal I/F 122.

The controller 120 includes a CPU 123, a RAM 124 which serves as a work memory of the CPU 123 or a buffer memory for data related with ejection control, a ROM 125 which stores various control information, a signal generating circuit 126 which generates a clock signal CK, and a driving signal generating circuit 127 which generates a driving signal COM. Here, as the ROM 125, an EEPROM which is rewritable may be used.

The ejection driving circuit 131 includes a shift register circuit including a shift register 132, a latch circuit 133, a level shifter 134, and a switch 135, so that the ejection driving circuit 131 can selectively apply a driving signal (COM) to each piezoelectric element 136. The driving signal (COM) is constructed by combining charge and discharge signals.

A printing operation is performed by transmitting drawing pattern data in a so-called bitmap format which represents disposition of ink droplets in paper 2 (see FIG. 1) from the host computer 119 to the controller 120. At this time, the controller 120 decodes the drawing pattern data to generate nozzle data which is ON/OFF data for each nozzle.

A nozzle data signal (SI) which is a serial signal converted from the nozzle data is transmitted to the shift register circuit in synchronization with a clock signal (CK), and accordingly, the ON/OFF data for each nozzle is stored in a corresponding shift register 132. Then, the nozzle data related with "ON" data which is latched by the latch circuit 133 in accordance with a latch signal (LAT) is converted into a predetermined voltage signal by the level shifter 134 to be supplied to the switch 135.

As described above, a driving signal COM is applied to a piezoelectric element 136 corresponding to ON data, and accordingly, ink is ejected from a nozzle. The ejection control (drawing control) based on the drawing pattern data is performed periodically in synchronization with a scan position of the ejection head 10.

The controller 120 may perform preliminary ejection or supplementary ejection by generating a corresponding nozzle data signal (SI), a corresponding driving signal (COM), or the like in a form interrupting the drawing control process. In other words, the controller 120 serves as a preliminary ejection means and a supplementary ejection means according to an embodiment of the invention.

Here, the preliminary ejection is ejection which is performed on the cap 11 for nozzle maintenance before/after a drawing operation or in the middle of the drawing operation. The preliminary ejection is performed for restoring and maintaining the performance of ejection by replacing old ink in a nozzle with new ink or improving moisturization in a capped status by providing the absorber 13 (see FIG. 2) with moisture.

The supplementary ejection is performed for supplementing ink to the absorber 13 (see FIG. 2) before the inside cap ejection. The supplementary ejection is performed on the cap 11 (see FIG. 2) like the preliminary ejection, but the supplementary ejection is always performed with the inside cap suction, and the amount of ejection of the supplementary ejection per one operation is configured to be several times to several ten times that of the preliminary ejection.

Nozzle Maintenance of Liquid Ejection Apparatus

Hereinafter, the nozzle maintenance of the liquid ejection apparatus according to flowcharts of FIGS. 4 and 5 will be described with reference to FIGS. 2 and 3.

Figure 4:
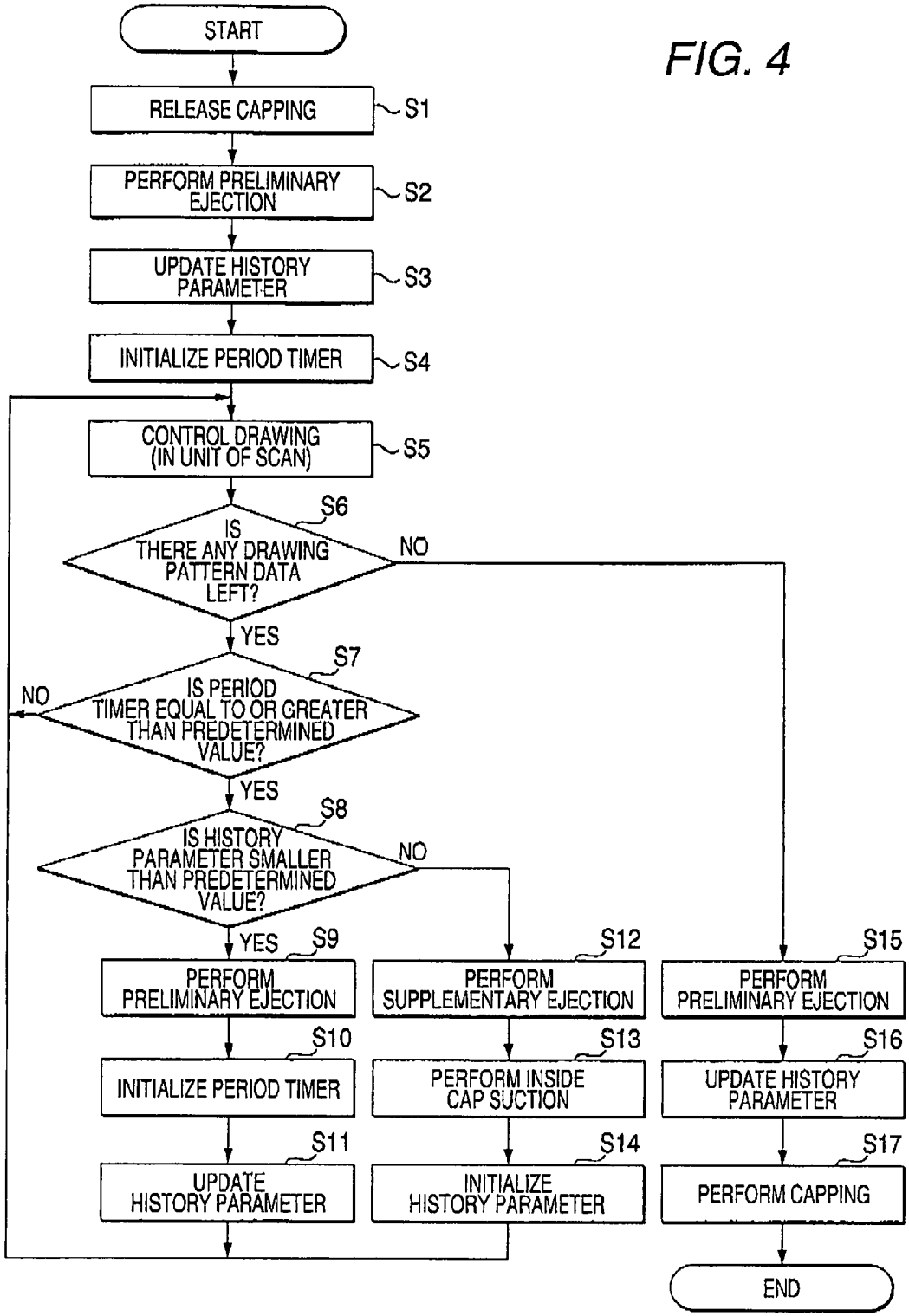
FIG. 4 is a flowchart showing a process related to a drawing operation.

FIG. 4 is a flowchart showing a process related to a drawing operation. FIG. 5 is a flowchart showing a process related to the nozzle maintenance at the time when a main power is turned off.

The opening of the nozzle 21 is in a capped status (capped status) when the printer 1 is not operated. When a drawing command is received from the host computer 119, the printer 1 performs a process according to the flowchart shown in FIG. 4.

The controller 120, at first, releases the capping by driving the scan motor 104 (step S1), and then performs preliminary ejection on the cap 11 (step S2), update of a history parameter (step S3), and initialization of a period timer (step S4).

In the step S2, the preliminary ejection is performed for restoring the performance of ejection by discharging ink which has been dried during a capped status from the inside of the nozzle 21. Alternatively, the preliminary ejection may not be performed for a specific type of ink, or it may be determined whether the preliminary ejection is performed with reference to an elapsed time after the latest drawing operation.

The history parameter in the step S3 is a parameter representing the history of preliminary ejection, and described in more details, the history parameter represents an accumulated amount of moisturizing components which is acquired by adding up the amount of a moisturizing component included in the amount of ejection per each preliminary ejection. The history parameter may be acquired by counting the amount of the moisturizing components, but since the amount of the moisturizing component included in the amount of ejected ink is the same for the same ink, the history parameter may be set as the number of ink droplets ejected, a value corresponding to the amount of consumed ink, or a value corresponding to the number of preliminary ejection (the number of ejection driving or the number of operations). In this case, the history parameter may be a corresponding value in any unit of one nozzle, one ink-type, or the total nozzle. As described above, the controller 120 serves as a history management means which manages the history of the preliminary ejection by using the history parameter. In addition, since the amount of the moisturizing component differs by the color of ink, it is preferable that the amount of the moisturizing component is added up for each color to be managed.

The period timer in the step S4 is used for defining execution timing of preliminary ejection operations (step S9) which is executed regularly during a drawing operation. As shown in the flowchart of FIG. 4, the period timer counts from a time right after preliminary ejection (steps S2 and S9).

After the step S4, the controller 120 performs drawing control for one scan (step S5) and determines whether there remains drawing pattern data which has not been processed (step S6).

When it is determined that there is no remaining drawing pattern data in the step S6, the controller 120 performs a nozzle maintenance process (steps S15 to S17) for completing the drawing operation. In other words, after the preliminary ejection into the inside of the cap 11 (step S15) and update of the history parameter (step S16) are performed, the nozzle 21 is protected by the capping (step S17).

The preliminary ejection in the step S15 is performed for moisturizing the absorber 13 in the cap 11. By the preliminary ejection, high humidity is maintained in the sealed internal space in a capped status to properly prevent the ink in the inside of the nozzle 21 from being dried.

On the other hand, when it is determined that there is remaining drawing pattern data in the step S6, the controller 120 determines whether the value of the period timer is equal to or greater than a predetermined value (step S7).

When it is determined that the value of the period timer is smaller than a predetermined value in the step S7, the control is moved back to the above-described process of the step S5 and the process described above is repeated. In other words, the drawing control (step S5) in the unit of the scan is repeated many times until the value of the period timer reaches a predetermined value.

When it is determined that the value of the period timer is equal to or greater than a predetermined value in the step S7, the controller 120 determines whether the history parameter is smaller than a predetermined value (step S8).

While the ink in the cap evaporates as time elapses, the moisture in the ink evaporates and a moisturizing component (glycerin or the like) does not evaporate. The moisturizing component has a property of collecting and storing moisture, and when the amount of moisture in a surrounding space is not sufficient, the moisturizing component tries to absorb moisture from the surrounding space more strongly. Accordingly, the moisturizing component takes moisture from the ink inside the nozzle. A predetermined value of the history parameter for which determination is made is the amount of accumulated moisturizing component causing the deterioration of ejection due to increased viscosity of the ink at a time when the moisture of the ink evaporates and the moisture of the ink in the inside of the nozzle is taken according to the amount of the accumulated moisturizing component. The moisturizing component doest not try to take moisture from the ink in the nozzle when the moisture of the ink has not evaporated. However, even in a capped status, when the printing is not operated, the moisture in the ink evaporates, although the moisturizing component doest not try to take moisture from the ink inside the nozzle in a status that the moisture of the ink is not evaporated. In other words, it can not be predicted when the moisturizing component starts to take moisture from the ink in the inside of the nozzle. Accordingly, the moisturizing component in the inside of the cap is washed to be flown out using the amount of the accumulated moisturizing component which will cause deterioration of ejection in the future as a threshold value, regardless of the evaporation of the moisture.

In the step S8, when it is determined that the history parameter is smaller than a predetermined value, the controller 120 performs a nozzle maintenance process (steps S9 to S11) during a drawing operation for maintaining the performance of ejection. In other words, the initialization (step S10) of the period timer and the update of the history parameter (step S11) are performed together with the preliminary ejection (step S9) into the cap 11.

The preliminary ejection in the step S9 is performed for forcedly replacing old ink in the inside of the nozzle 21 for which a drying has been processed during a drawing operation with new ink. By the preliminary ejection, the ejection of the ink at a minimum level can be assured regardless of the ejection based on the drawing pattern data, and accordingly, the performance of the ejection during the drawing operation can be properly maintained.

After the step S11, the control is moved back to the process of the step S5, and the above-described process is repeated. As described above, the preliminary ejection (step S9) is performed during a drawing operation intermittently in a periodic timing.

When it is determined that the history parameter is equal to or greater than the predetermined value in the step S8, the controller 120 performs a process for forcedly discharging the ink accumulated in the absorber 13. In other words, the preliminary ejection into the cap 11 (step S12) and the inside cap suction (step S13) are performed consecutively.

The preliminary ejection (step S2, S9, and S15) is intermittently performed to be in a status that the history parameter is increased, and the ink included in the absorber 13 by the preliminary ejection loses much moisture to be in a high viscosity status. The old ink which has lost moisture precipitates the drying process in the inside of the nozzle 21 in a capped status by the action of the moisturizing component (glycerin or the like) included in the ink. The inside cap suction in the step S13 is performed for forcedly discharging the old ink that causes the negative effect.

The old ink to be in a high viscosity status cannot be easily discharged due to a decrease in mobility, but in an embodiment of the invention, the inside cap suction (step S13) is performed after a considerable amount of ink is supplemented to the absorber 13 by the supplementary ejection (step S12), thereby increasing the amount of discharge of the old ink. That is because that the old ink which is accumulated in the absorber 13 is washed to be flown out by the newly supplemented ink for being properly discharged. In addition, the newly supplemented ink is absorbed into the inside of the cap (step S13), and apart of the supplemented ink is maintained in the absorber 13 to maintain the capped and sealed internal space to be in a high humidity status.

It is preferable that the amount of ejection of the ink performed by the supplementary ejection (step S12) is to be greater than the amount of the moisturizing component in the ink which is accumulated in the absorber 13. It is more preferable that the amount of ejection of the ink performed by the supplementary ejection is two to three times (weight ratio) greater than the amount of the moisturizing component in the ink. In the embodiment, ink including the moisture component of 10 to 20 wt % (containing ratio differs by the ink type) is used and ink corresponding to 50% of the total amount of ejected ink by the preliminary ejection is configured to be supplied by the supplementary ejection (step S12).

Since most of the old ink accumulated in the absorber 13 is discharged by the supplementary ejection (step S12) and the inside cap suction (step S13), the history parameter is initialized in the following step S14. That is because the history parameter becomes an index of the amount of the ink accumulated in the absorber 13 by the preliminary ejection. In addition, the history parameter is initialized when a nozzle suction operation is performed for removing fixed ink or bubbles which are in the inside of the nozzle 21, for the same reason.

After the step S14, the control is moved back to the step S5, and the above-described process is repeated. In other words, the forced discharge (steps S12 and S13) of the ink ejected by the preliminary ejection from the cap 11 is regularly performed at a timing when the history parameter reaches a predetermined value.

Regularly performing the forced discharge (steps S12 and S13) of old ink with reference to the history parameter is for efficient discharge of the old ink. In other words, when the old ink is excessively accumulated in the absorber 13, the supplement of markedly large amount of ink is required for discharging the old ink, or sufficient discharge of the old ink cannot be made. The printer 1 which has completed the drawing operation waits for a command from the host computer 119 or the like in a non-operated status, and when the printer receives a new drawing command, the above-described steps S1 to S17 are performed. In this case, the value of the history parameter at a time when the previous drawing operation is completed is continuously used.

Figure 5:
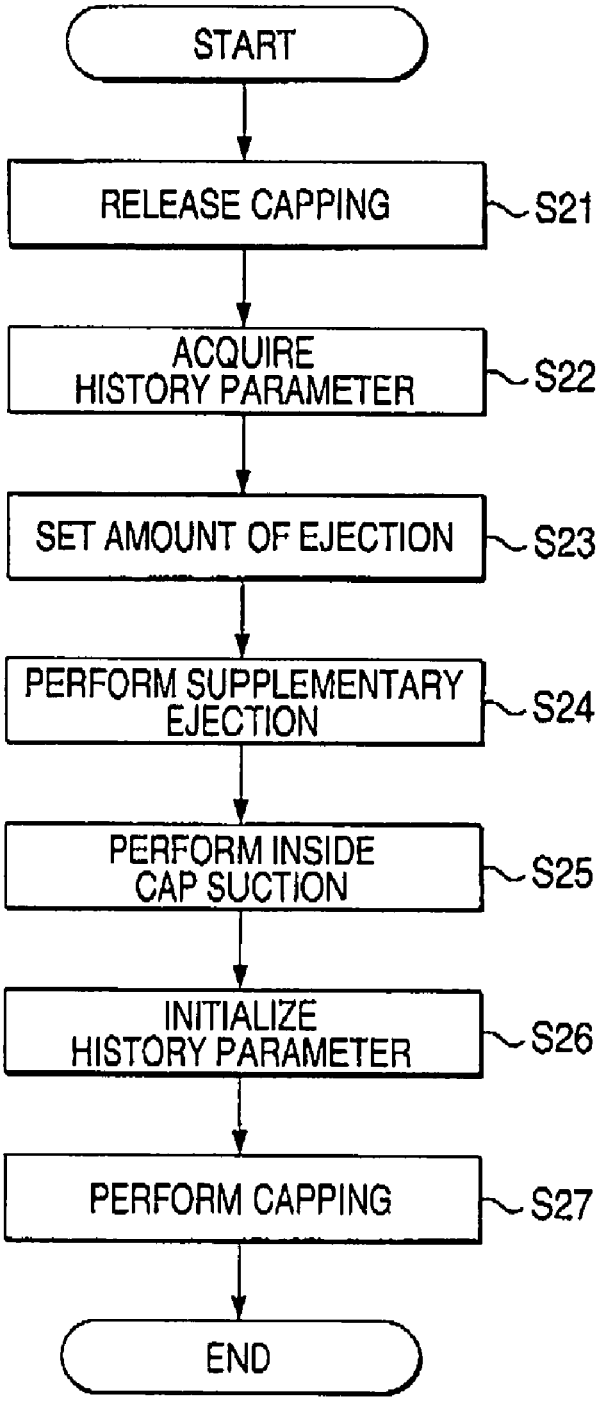
FIG. 5 is a flowchart showing a process related to nozzle maintenance at the time when a main power is turned off.

When an operation of turning off a main power switch of the printer 1 is performed by a hardware switch (not shown), the printer 1 performs a process according to the flowchart shown in FIG. 5.

The controller 120, at first, releases the capping by driving the scan motor 104 (step S21). Next, the controller 120 acquires the history parameter (step S22) and sets the amount of ejection for the next supplementary ejection based on the acquired history parameter (step S23). The controller 120 performs the supplementary ejection (step S24) and the following inside cap suction (step S25) according to the set amount of ejection and initializes the history parameter (step 526) to perform capping (step S27).

As described above, when the main power is turned off, an operation of discharging ink combining the supplementary ejection (step S24) and the inside cap suction (step S25) are performed regardless of the value of the history parameter at that time. When the main power is turned off, a case where the printer 1 may not be operated for a long time thereafter is assumed, and accordingly, a proper prevention of a drying process in the inside of the nozzle 21 is pursued by discharging the old ink accumulated in the absorber 13.

The supplementary ejection in the step S24 is performed based on the set amount of ejection which is set with reference to the history parameter. This is for preventing waste of unnecessary ink due to the supplemental ejection (step S24) by supplementing sufficient ink required to wash old ink to be flown out based on the amount of the old ink accumulated in the absorber 13.

MODIFIED EXAMPLE 1

Next, a modified example 1 will be described with reference to a flowchart shown in FIG. 6 with primarily focusing on the difference from the previous embodiment of the invention.

Figure 6:
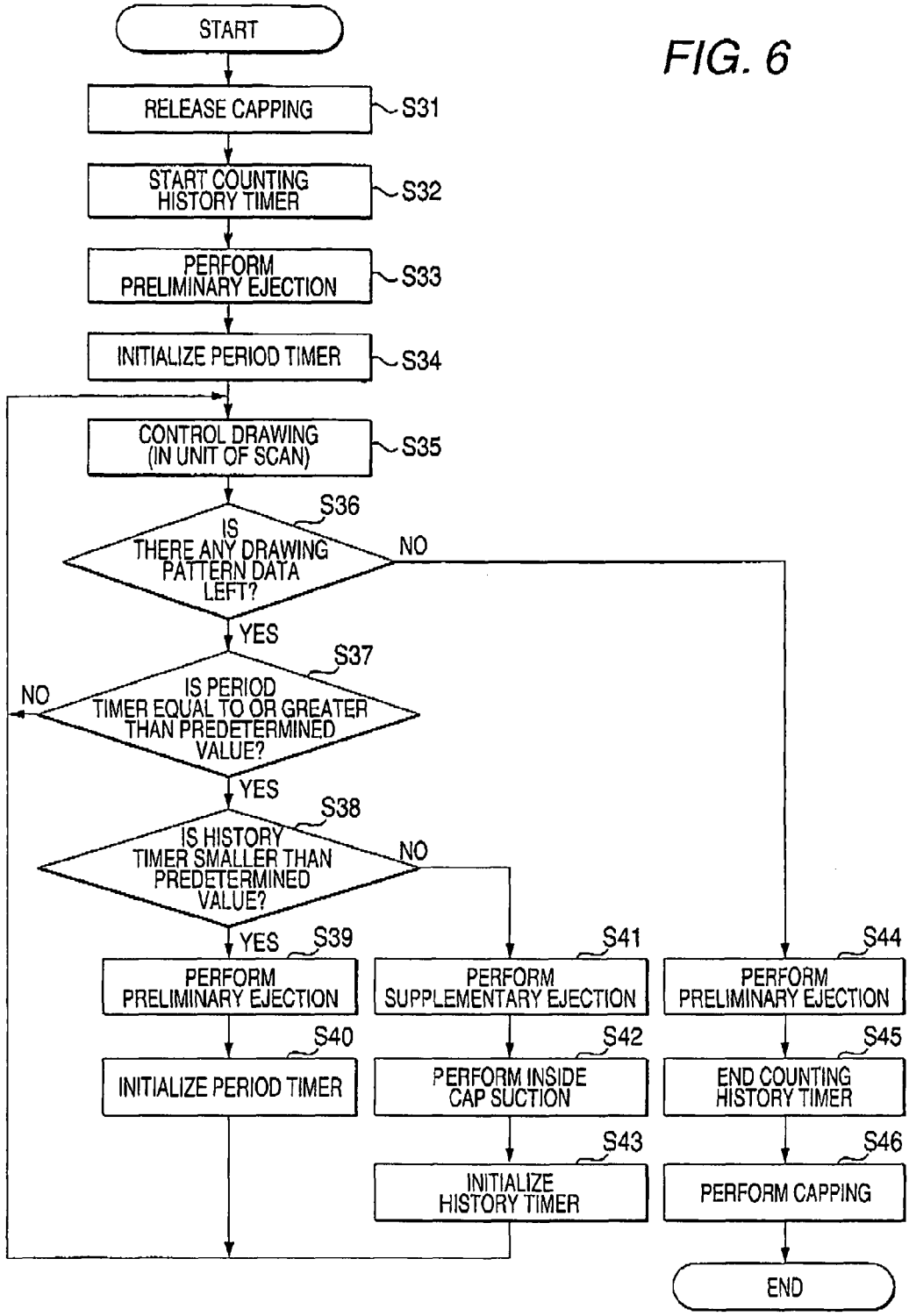
FIG. 6 is a flowchart showing a process related to a drawing operation in a modified example 1.

FIG. 6 is a flowchart showing a process related with a drawing operation in the modified example 1.

In the modified example 1, the processes related with the preliminary ejection (steps S33, S34, S37, S39, S40, and S44), a drawing process (step S35), and the determining process of the completion of the drawing operation (step S36) are the same as those of the previous embodiment, and accordingly, the description thereof will be omitted.

In the modified example 1, the supplementary ejection (step S41) and the determination (step S38) on performing the inside cap suction (step S42) are performed based on a history timer. The history timer counts up the accumulated time of the drawing operation as an indirect management tool managing a history related to the preliminary ejection, since the preliminary ejection (steps S33, S39, and S44) related to the drawing operation is periodically performed on the whole. As in the modified example 1, the history related to the preliminary ejection may be managed based on a related time or the like.

To be described in more details, the history timer starts counting (step S32) right after the release of the capping (step S31) and ends the counting (step S45) right before the capping (step S46). The value of the history timer is maintained after one drawing operation ends but is initialized when the inside cap suction (step S42) is performed (step S43) or the nozzle suction operation is performed.

MODIFIED EXAMPLE 2

Hereinafter, a modified example 2 will be described with primarily focusing on the difference from the above-described embodiment.

In the modified example 2, a cap for capping a nozzle in response to each type of ink is prepared independently or is prepared by being divided, and accordingly the preliminary ejection, the supplementary ejection, or the inside cap suction is performed for each type of ink. In this case, the amount of ejection for the supplementary ejection is set for each type of ink. This is for preventing unnecessary consumption of ink in the supplementary ejection through optimization, since the amount of a moisturizing component of ink or the like is different by the type of ink and there is a difference in an optimal amount of the supplemental ink required to wash the old ink to be flown out from the absorber. In this case, the history parameter or the history timer which indicate the history of the supplementary ejection may count for each type of ink.

The present invention is not limited to the above-described embodiments.

For example, it is assumed that there is the history of the preliminary ejection according to an embodiment of the invention, but an embodied form related with performing the preliminary ejection is not limited to the above-described embodiment, and as long as the purpose is maintenance of a nozzle, many conditions may be modified and added in the embodied form.

In addition, the timing, determination condition, or the like for performing the supplementary ejection and the cap-in suction may be changed arbitrary in the range that the gist of the invention is unchanged.

In addition, the present invention may be applied to an industry-use drawing apparatus, and in this case, the moisture component of the liquid may include an organic solvent as well as water.

In addition, the configurations of the embodiments may be properly combined, omitted, or combined with any other configuration which is not shown.

What is claimed is:

1. A liquid ejection apparatus comprising:

an ejection head that ejects a liquid from a nozzle;

a cap that can seal an opening of the nozzle;

an absorber that is disposed in the inside of the cap;

a first ejection unit that allows to perform a first ejection toward the cap for maintenance of the nozzle;

a suction unit that sucks the liquid from the cap;

a second ejection unit that allows to perform a second ejection toward the cap for supplementing the liquid to the inside of the cap, before the suction; and a history managing unit that manages information on an accumulated ejection amount of a moisturizing component of the first ejection, wherein the second ejection unit allows to perform the second ejection on a condition based on the information.

2. The liquid ejection apparatus according to claim 1, wherein the liquid ejection apparatus includes a plurality of the nozzles and the caps provided for each one of a plurality of liquid types, and wherein the second ejection unit sets an ejection amount of a moisturizing component of the second ejection for each of the liquid types.

3. The liquid ejection apparatus according to claim 1, wherein the second ejection unit allows to perform the second ejection right before a main power is turned off.

4. A liquid ejection apparatus comprising:

an ejection head that ejects a liquid from a nozzle;

a cap that can seal an opening of the nozzle;

an absorber that is disposed in the inside of the cap;

a first ejection unit that allows to perform a first ejection toward the cap for maintenance of the nozzle;

a suction unit that sucks the liquid from the cap;

a second ejection unit that allows to perform a second ejection toward the cap for supplementing the liquid to the inside of the cap, before the suction; and a history managing unit that manages an accumulated time of drawing operations, wherein the second ejection unit allows to perform the second ejection on a condition based on the accumulated time.

5. The liquid ejection apparatus according to claim 4, wherein the liquid ejection apparatus includes a plurality of the nozzles and the caps provided for each one of a plurality of liquid types, and wherein the second ejection unit sets an ejection amount of a moisturizing component of the second ejection for each of the liquid types.

6. The liquid ejection apparatus according to claim 4, wherein the second ejection unit allows to perform the second ejection right before a main power is turned off.

* * * * *